US006675552B2

(12) United States Patent
Kunz et al.

(10) Patent No.: US 6,675,552 B2
(45) Date of Patent: Jan. 13, 2004

(54) METHOD AND DEVICE FOR PRODUCING BAGS WITH THREE SEALED EDGES AND WELDED-IN CLOSING SEAL

(75) Inventors: Rico Kunz, Uster (CH); Thomas Strasser, Benken (CH); Ernst Wanner, Schaffhausen (CH); Horst Loewenthal, Waldshut-Tiengen (DE)

(73) Assignee: SIG Pack Systems AG, Beringen (CH)

( * ) Notice: Subject to any disclaimer, the term of this patent is extended or adjusted under 35 U.S.C. 154(b) by 377 days.

(21) Appl. No.: 09/726,456

(22) Filed: Dec. 1, 2000

(65) Prior Publication Data

US 2001/0003115 A1 Jun. 7, 2001

(30) Foreign Application Priority Data

Dec. 3, 1999 (CH) ..... 2217/99

(51) Int. Cl.[7] ..... B65B 61/20

(52) U.S. Cl. ..... 53/133.4; 53/412; 53/139.2; 53/450; 493/213; 493/927; 493/214

(58) Field of Search ..... 453/287, 288, 453/297, 308, 186, 189, 193, 194, 195, 200, 213, 218, 231, 243, 248; 53/412, 133.4, 139.2, 450, 550; 493/213, 121.4, 927; 383/63, 64; 156/66

(56) References Cited

U.S. PATENT DOCUMENTS

| | | | | | |
|---|---|---|---|---|---|
| 3,274,746 | A | * | 9/1966 | James et al. | 53/433 |
| 4,812,074 | A | * | 3/1989 | Ausnit et al. | 493/213 |
| 4,876,842 | A | * | 10/1989 | Ausnit | 53/133.1 |
| 4,878,987 | A | * | 11/1989 | Ven Erden | 156/519 |
| 4,941,307 | A | * | 7/1990 | Wojcik | 53/412 |
| 5,071,689 | A | * | 12/1991 | Tilman | 428/121 |
| 5,205,808 | A | * | 4/1993 | Gebhardt | 493/194 |
| 5,247,781 | A | * | 9/1993 | Runge | 493/213 |
| 5,322,579 | A | | 6/1994 | Van Erden | |
| 5,746,043 | A | * | 5/1998 | Terminella et al. | 53/451 |
| 5,832,698 | A | * | 11/1998 | Huguenin | 53/451 |
| 6,003,582 | A | * | 12/1999 | Blohowiak et al. | 156/567 |
| 6,032,437 | A | * | 3/2000 | Bois | 53/412 |
| 6,044,621 | A | * | 4/2000 | Malin et al. | 493/214 |
| 6,088,998 | A | * | 7/2000 | Malin et al. | 493/214 |
| 6,099,451 | A | * | 8/2000 | Mulder et al. | 493/213 |
| 6,138,436 | A | * | 10/2000 | Malin et al. | 53/133.4 |
| 6,185,907 | B1 | * | 2/2001 | Malin et al. | 493/34 |
| 6,251,209 | B1 | * | 6/2001 | Johnson | 156/201 |
| 6,327,754 | B1 | * | 12/2001 | Belmont et al. | 24/400 |
| 6,327,837 | B1 | * | 12/2001 | Van Erden | 53/412 |
| 6,350,340 | B1 | * | 2/2002 | Johnson | 156/218 |
| 6,477,821 | B1 | * | 11/2002 | Bois | 53/412 |

FOREIGN PATENT DOCUMENTS

| | | | | |
|---|---|---|---|---|
| EP | 0 667 288 | | 4/1998 | |
| EP | 0 939 034 | | 9/1999 | |
| WO | 99/20529 | | 4/1999 | |
| WO | WO 99/20529 | * | 4/1999 | B65B/9/20 |

* cited by examiner

*Primary Examiner*—Rinaldi I. Rada
*Assistant Examiner*—Louis Tran
(74) *Attorney, Agent, or Firm*—Venable LLP; Robert Kinberg; Chad C. Anderson

(57) ABSTRACT

A packaging foil is continuously withdrawn from a supply. The foil is folded around the products to be packaged. Cut-off lengths of closing profile sections are inserted with a feed unit between the two longitudinal edges of the foil. In a sealing station, the two longitudinal edges of the foil are sealed together and the foil is then sealed onto the closing profile sections. In another sealing station, transverse sealing seams are formed between the free ends of successive closing profile sections and the tube is cut approximately in the center of the transverse seams. A high packaging output is achieved as a result of the continuous withdrawal of the foil.

7 Claims, 2 Drawing Sheets

METHOD AND DEVICE FOR PRODUCING BAGS WITH THREE SEALED EDGES AND WELDED-IN CLOSING SEAL

CROSS-REFERENCE TO RELATED APPLICATIONS

This application claims the right of priority of Swiss patent application No. 2217/99 filed Dec. 3, 1999, the disclosure of which is incorporated herein by reference.

BACKGROUND OF THE INVENTION

The invention relates to a method and a device for producing bags with three sealed edges and a welded-in closing profile. For example, European Patent Document No. B 667 288 discloses that a packaging foil is withdrawn gradually from a supply and is wound around a collar to form a cylindrical, downward moving tube. In the area adjacent to the two overlapping longitudinal edges of the foil, closing profile sections are supplied and inserted between the foil edges and are sealed to the foil with sealing jaws that are moved in time against the foils. The product to be packaged is filled in incrementally from the top and through the collar. The package formed in this way is then sealed with a transverse sealing seam by using sealing jaws that move in time, after which the package is separated. In the next step, the package is advanced and the following tube segment is filled. The closing profile sections are nearly as long as the inside distance between the transverse sealing seams. A similar device of this type, which also has a timed operation, is described in International Patent Application Publication No. WO 99/20529.

European Patent Document No. A 939 034 discloses another device for producing bags with three sealed edges. The device relates to a horizontal, tube-type bag-producing machine. The zipper is welded in as continuous ribbon between longitudinal edges of a continuously withdrawn foil that is folded around the products and the foil is simultaneously welded on along the free edges. Transverse sealing seams are formed in a transverse sealing station and the individual bags are then separated.

SUMMARY OF THE INVENTION

It is an object of the present invention to provide a method and a device of the aforementioned type that allows an increase in packaging speed. This object and others to become apparent as the application progresses, are accomplished by the invention. The method includes continuously withdrawing a packaging foil having two longitudinal edge regions with longitudinal edges from a first supply by means of a first feed unit. The packaging foil is folded. Cut-off lengths of closing profile sections are inserted between the two longitudinal edges of the packaging foil by means of a second feed unit so that successive closing profile sections are spaced apart. The two longitudinal edge regions are sealed substantially next to the longitudinal edges to form a longitudinal sealing seam on both sides onto the closing profile sections. A traverse seal is made using a transverse sealing device to effect transverse sealing of successive closing profile sections to thereby form individual bags and the individual bags are separated.

The device includes a first supply of a packaging foil having two longitudinal edge regions having longitudinal edges; a first feed unit for withdrawing the foil having a continuously driven first motor; a folding station for forming a flat tube from the foil so that the tube is open on one side and holds the products to be packaged; a second feed unit having a second motor for supplying and inserting cut-off lengths of closing profile sections between the two longitudinal edges of the foil; a first sealing station having two continuous first sealing jaws that are constantly positioned generally adjacent to each other for sealing the closing profile sections to respective longitudinal edge regions to substantially meet to the longitudinal edges of the foil; a second sealing station having at least substantially adjacent second sealing jaws for the sealing the two foil edges in longitudinal direction in a location substantially next to the longitudinal edges of the foil and outside of ends of the cut-off lengths of closing profile sections; a third sealing station for forming transverse seams between the ends of successive cut-off lengths of closing profile sections; and a separating device that cuts the tube transversely at least approximately in the center of the transverse seams. At least a portion of the first feed unit is arranged downstream of the first and second sealing stations.

DETAILED DESCRIPTION OF THE PREFERRED EMBODIMENTS

Figure 1:
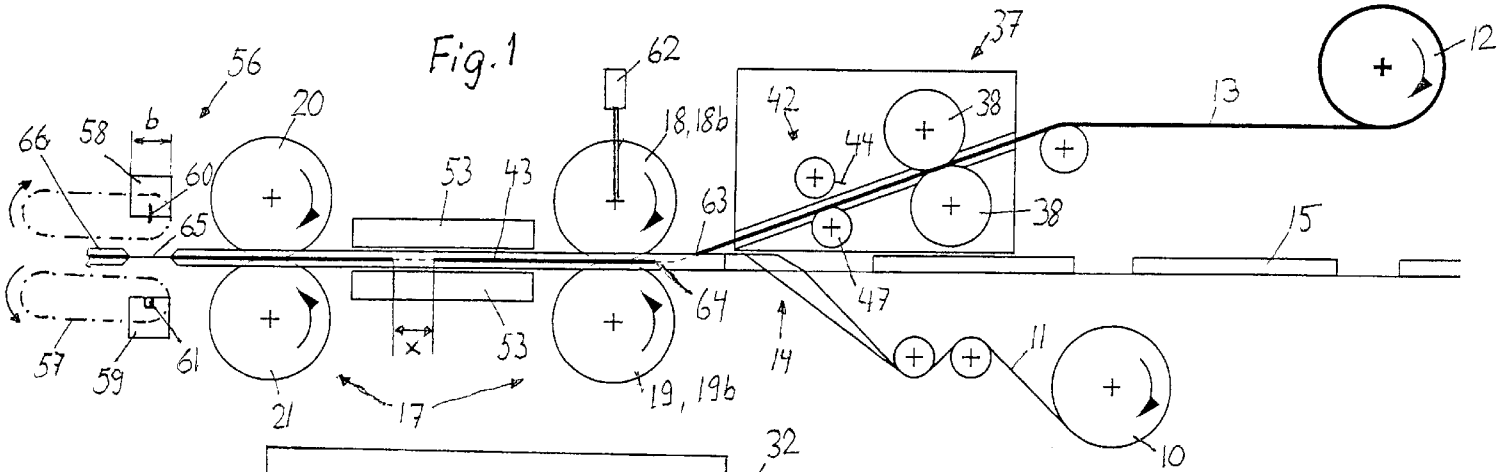
FIG. 1 is a side view of a device according to the invention.
Figure 2:
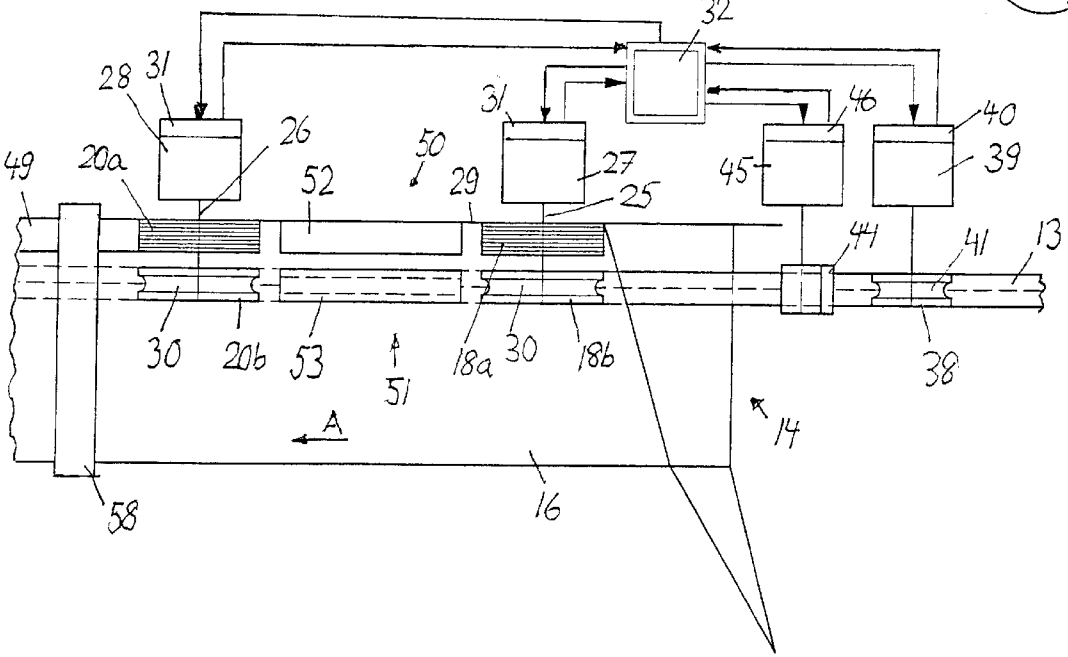
FIG. 2 is a top view of the device shown in FIG. 1.

The device shown in FIGS. 1 and 2 contains a first supply reel for a thermoplastic packaging foil 11 or a compound foil, as well as a second supply 12 for a closing profile section 13 (e.g., a zipper section). The foil 11 is folded in a folding station 14 in the known way over a folding edge and around the products 15, which are also supplied in the known way at regular intervals, so that a flat, horizontal tube 16 is formed. The folding station 14 is illustrated in a considerably shortened scale in FIGS. 1 and 2, as seen in transporting direction A of tube 16. Alternatively, the supply 10 can already contain a folded tube. The tube 16 is withdrawn continuously from the supply 10 with the aid of a first feed unit 17. The unit 17 consists of two driving roller pairs 18, 19 or 20, 21. Each roller 18–21 consists of two coaxial individual rollers 18*a*, 18*b*, 20*a*, 20*b* that are mounted on the same shaft 25, 26. At least one of the rollers 18, 20 of each pair is driven by a servomotor 27, 28. The individual rollers 18*a*, 20*a*, grip the foil along its free edges 29. The individual rollers 18*b*, 20*b* are provided with a circumferential groove corresponding to half the cross-sectional profile of the closing profile section 13. The motors 27, 28 are connected to sensors 31 for sensing the angle of rotation. A single motor 27 that synchronously drives both roller pairs 18, 19, 20 and 21 can alternatively be provided for the feed unit 17. The motors 27, 28 and the angle of rotation sensors 31 are connected to a control device 32.

The closing profile section 13 is withdrawn from the supply 12 with the aid of a second feed unit 37. The unit 37 comprises a driving roller pair 38 that is driven by a servomotor 39 with angle of rotation sensor 40, both of which are also connected to the control device 32. The rollers 38 are provided with a circumferential groove 41 that matches the groove 30. A separating device 42 for cutting the closing profile section 13 into closing profile sections 43 is arranged downstream of the rollers 38. The device 42 consists of a rotating blade 44 that is operated by another servomotor 45 with angle of rotation sensor 46. These are also connected to the device 32. The blade 44 operates jointly with a rotating or stationary counter part.

The closing profile sections 43 are supplied by the unit 37 and are inserted between the two foils, at a distance to but adjacent to the edges 29. Two longitudinal sealing stations 50, 51 are arranged between the two roller pairs 18, 19 or 20, 21, which serve to form a longitudinal sealing seam 49 and to seal the foil 11 on both sides onto the closing profile sections 43. The stations 50, 51 consist respectively of one pair of constantly at least nearly adjacent heated sealing jaws 52, 53, which can be coated with PTFE on the side facing the foil 11. The foil 11 is pulled continuously through the jaws 50, 51 by the roller pair 20, 21. The rollers 20, 21 can be cooled and thus ensure a quick cooling down of the sealing seams.

A transverse sealing station 56 is arranged downstream of the roller pair 20, 21. It consists of two transverse sealing jaws 58, 59 that circulate on oval tracks 57. A separating device consisting of a blade 60 and counter part 61 can be integrated into the jaws 58 and 59. The type of guide used for the jaws 58, 59 is known from prior art. The blade separates the tube 16 into individual bags 66.

One of the rollers 18, 19 can also be provided with a sensor 62, which is also connected to the control device 32. The sensor 62 can, for example, be a force sensor or a distance sensor. If the leading end 63 of a closing profile section 43 is gripped between the rollers 18*b*, 19*b*, these are pushed apart slightly to generate the necessary contact pressure of the foil onto the closing profile section 43. The increased contact pressure or the displacement it causes is detected with the aid of sensor 62.

The above-described device operates as follows: The foil 11 is withdrawn continuously from the unit 17. The unit 37 also transports the closing profile section 13 at a continuous speed. Once the sensor 62 responds, its signal triggers a rotation of blade 44 by 360° by way of the device 32 and delayed by an adjustable angle of rotation that is measured with the angle of rotation sensor 31. The rotational speed of the cutting edge in this case corresponds to the advancing speed of closing profile section 13, which is synchronized with the withdrawal speed of foil 16. As soon as the separating cut is carried out, the device 32 slows down the motor 39 briefly and then accelerates it again to the synchronous speed. A distance x is formed in this way between the leading end 63 of closing profile section 43 and the trailing end 64 of the preceding closing profile section 43. This distance x corresponds to or is slightly larger than the width b of transverse sealing jaws 61. The transverse sealing seams 65 are formed only in this gap between two successive closing profile sections 43, thereby resulting in a satisfactory seal and excellent tightness. A high packaging output is achieved due to the continuous withdrawal rate.

As an alternative to triggering the blade 44 with the aid of sensor 62, the command for triggering the separating movement of blade 44 can also be derived exclusively from the angle of rotation of the roller pair 18, 19, which is measured with the sensor 31. An exact positioning of the closing profile sections 43 between the transverse seams 65 is achieved with the above-described type of control. The device 37 can also be used for retrofitting existing horizontal packaging machines for tube-shaped bags and is particularly suitable for packaging machines of this type.

Figure 3:
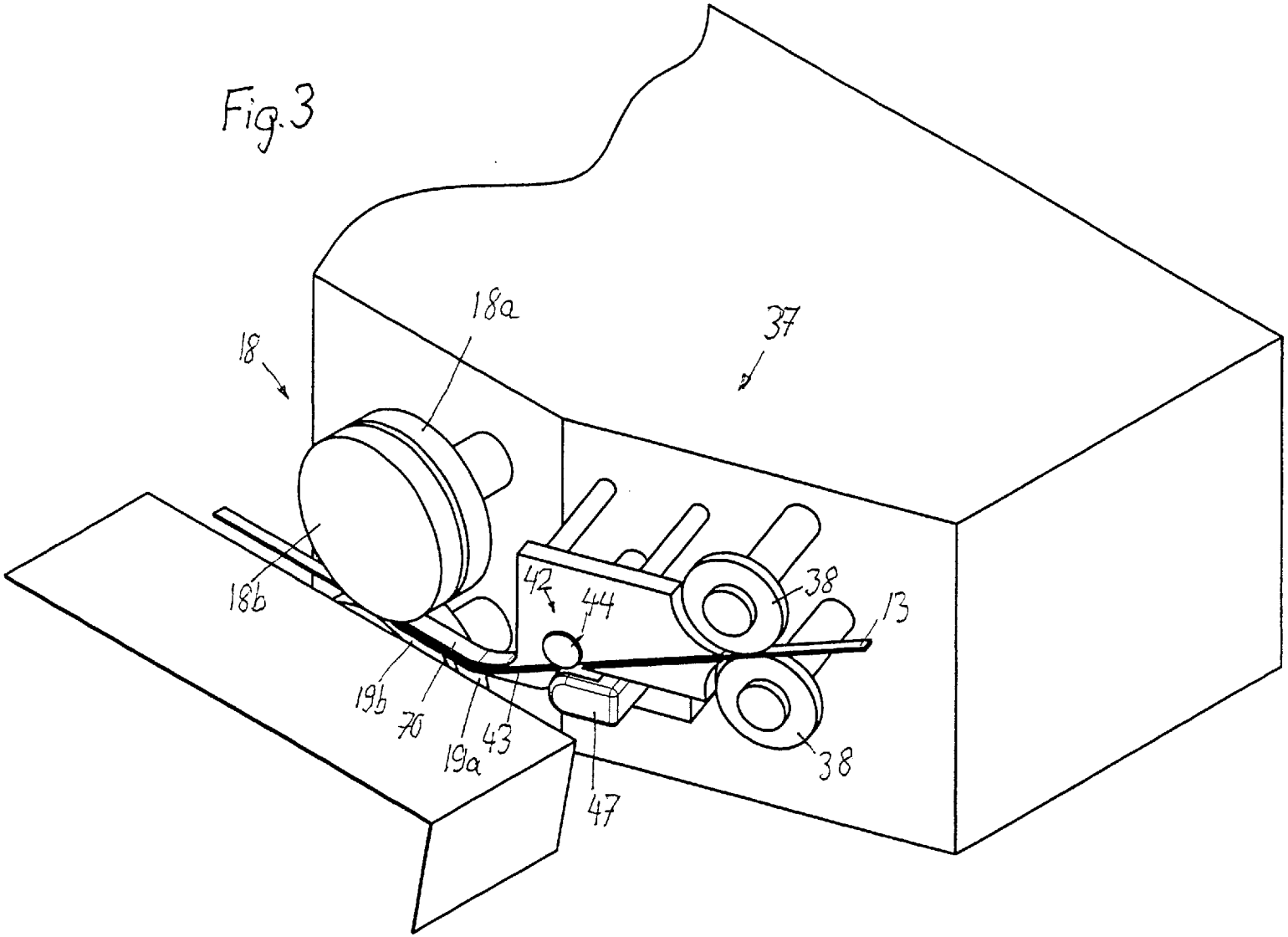
FIG. 3 is a perspective view of another embodiment according to the invention.

FIG. 3 shows a detail of a modified version of the embodiment according to FIGS. 1 and 2. In FIGS. 1 and 2, the rollers 38 and the supply 12 are arranged in the vertical center plane through the sealing jaws 53. In contrast, the vertical plane through the rollers 38, the blade 44 and the supply for the variant according to FIG. 3 is arranged at an acute angle to this center plane. The cut-off closing profile sections 43 are supplied via a bent guide rail 70 to the rollers 18*b*, 19*b*. This variant can have advantages for supplying and inserting the products 15 between the folded foil 11.

It will be understood that the above description of the present invention is susceptible to various modifications, changes and adaptations, and the same are intended to be comprehended within the meaning and range of equivalents of the appended claims.

What is claimed is:

1. A device for producing bags with three sealed edges and a sealed-in closing section, said device comprising:

a first supply of a packaging foil;

a first feed unit for withdrawing the foil having a continuously driven first motor;

a folding station for forming a flat tube from the foil that has a first and a second longitudinal edge so that the first longitudinal edge lays above the second longitudinal edge and wherein the first and second longitudinal edge of the unfolded foil form together a third longitudinal edge of the folded foil with an edge region, so that the tube is open on one side and holds the products to be packaged;

a second feed unit having a second motor for supplying and inserting cut-off lengths of closing profile sections at a distance to but adjacent to the third longitudinal edge in said edge region and between said first and second longitudinal edges of the foil, wherein the inserted cut-off lengths have a longitudinal extension parallel to the third longitudinal edge of the folded foil;

a first sealing station being arranged in said edge region of the folded foil and having two continuous first sealing jaws that are constantly positioned generally adjacent to each other for sealing the closing profile sections to said edge region;

a second sealing station being arranged in said edge region of the folded foil and having at least substantially adjacent second sealing jaws for the sealing of the first and second longitudinal edges in longitudinal direction in a location substantially next to the third longitudinal edges of the foil and outside of ends of the cut-off lengths of closing profile sections;

a third sealing station for forming transverse seams between the ends of successive cut-off lengths of closing profile sections;

a separating device that cuts the tube transversely at least approximately in the center of the transverse seams, wherein at least a portion of the first feed unit is arranged downstream of the first and second sealing stations; and a control device for controlling the second feed unit, wherein the second feed unit has a second separating device having a third motor for cutting off the cut-off lengths of closing profile sections from a continuously supplied closing profile, and wherein the first motor is connected to a first sensor and the third motor is connected to a third sensor, said first and third sensors being connected to the control device for sensing an angle of rotation of the respective motor.

2. A device according to claim 1, wherein the first feed unit comprises a pair of drive rollers located upstream of the first and second sealing device and wherein the device further comprises a third sensor connected to the control device that senses when the leading end of the closing profile section is gripped by the drive roller pair.

3. A device according to claim 1, wherein the third motor is driven with a timed operation by the control device when the angle of rotation of the first motor has reached a predetermined value.

4. A device according to claim 1, wherein the third motor is driven with a timed operation by the control device in response to the third sensor.

5. A device according to claim 1, wherein the second motor is briefly delayed as soon as a closing profile section is cut off and is then subsequently accelerated again to the transporting speed of the tube.

6. A device according to claim 1, wherein the second separating device comprises a blade which rotates around a shaft and operates jointly with a counter part.

7. A device according to claim 1, wherein the first sealing jaws have a sealing surface with a depression that corresponds to a geometry of the closing profile section.

* * * * *